US005820034A

United States Patent [19]

Hess

[11] Patent Number: 5,820,034

[45] Date of Patent: Oct. 13, 1998

[54] CYLINDRICAL FLUIDIC CIRCUIT

[75] Inventor: Richard W. Hess, Ellicott City, Md.

[73] Assignee: Bowles Fluidics Corporation, Columbia, Md.

[21] Appl. No.: 839,153

[22] Filed: Apr. 23, 1997

[51] Int. Cl.[6] ..... B05B 1/08; F15C 1/08

[52] U.S. Cl. ..... 239/589.1; 239/590.5; 137/826; 137/835

[58] Field of Search ..... 137/826, 833, 137/835; 239/284.1, 589, 589.1, 590, 590.3, 590.5

[56] References Cited

U.S. PATENT DOCUMENTS

| | | | |
|---|---|---|---|
| 3,835,810 | 9/1974 | Hughes | 239/589.1 X |
| 4,055,302 | 10/1977 | Hruby, Jr. | 239/590.5 X |
| 4,185,777 | 1/1980 | Bauer | 239/589.1 X |
| 4,463,904 | 8/1984 | Bray, Jr. | 239/589.1 |
| 4,508,267 | 4/1985 | Stouffer | 239/589.1 X |
| 4,645,126 | 2/1987 | Bray, Jr. | 239/284.1 X |

*Primary Examiner*—Andres Kashnikow
*Assistant Examiner*—Robin O. Evans
*Attorney, Agent, or Firm*—Jim Zegeer, Esq.

[57] ABSTRACT

A fluidic oscillator comprises a housing having interior walls defining a cylindrical space therein, a fluidic oscillator is mounted in said cylindrical space and has an oscillating chamber having an upstream end and a downstream end. A power nozzle issues a jet of fluid into the oscillation chamber from the upstream end thereof, an outlet formed in the downstream end. A pair of control ports at opposing sides of the power nozzle are coupled to a pair of feedback entranceways in the downstream end of the oscillator chamber and at corresponding opposing sides of the outlet. The control passageways connect each feedback entranceway with the a control port on the opposing sides, respectively. Each control passageway is formed in part by the interior wall and the oscillator element.

5 Claims, 6 Drawing Sheets

CYLINDRICAL FLUIDIC CIRCUIT

BACKGROUND AND BRIEF DESCRIPTION OF THE INVENTION

The present invention relates to fluidic devices and more particularly to a fluidic element which is more compact and which is more amenable to adjustable fluidic nozzles.

In U.S. Pat. No. 4,185,777, owned by the assignee hereof, fluidic devices of simple construction which can be quickly and efficiently mass produced are disclosed. In that patent, a fluidic device silhouette is formed as recesses in an element surface of a body member. The recesses are sealed by an abutting surface of a cover member which is continually pressed against the element surface, thereby eliminating the need for adhesive material. The continuous pressing together of the two surfaces to form a pressure seal is accomplished by force fitting the two members together in a suitably contoured housing. In manufacturing operations under this patent, fluidic circuits typically used in windshield washer nozzles and other applications are manufactured in the shape of rectangular parallelepipeds (or chip). The feedback channels are usually contained in the fluidic geometry or silhouette into one surface of the parallelpipeds. The entire chip is then installed in a rectangular slot in a housing member designed to accept the circuit. A flat roof or floor of the slot is required to properly seal the circuit. By using this approach, the feedback channels are included in the geometry of silhouette molded in the chip, and the entire assembly is manufactured much larger than required to form the product contained in the fluidic circuit.

The object of the present invention is to provide a construction and method for substantially reducing the size of the fluidic oscillator product. For example, in the case of an industrial burner gas nozzle, the size of the nozzle can be reduced by a factor of about 16 or more using the techniques disclosed herein.

According to the invention, a cylindrical hole is used to eliminate the need for a flat surface to seal the fluidic circuit. A cylindrical hole is easier to mold, and the fluidic circuit is formed in the flat surface formed by molding or cutting a pin that is designed to fit in the cylindrical hole in half along its centerline. To gain space or reduce the size of the fluidic element, the fluidic circuit is reduced to the interaction region bounded by the upstream side of the power nozzle and by the outlet throat on the downstream side. The feedback channels are formed by creating a groove or channel along the outside surface of the pin halves. The internal surface of a cylindrical housing seals forms a part of and the control or feedback channels. In one preferred embodiment, two pieces are used to make the entire circuit, and in a second preferred embodiment, four pieces are utilized.

By forming the fluidic circuit in two halves of a spherical element, and installing the circuit in its spherical designed socket, it is possible to create an adjustable fluidic nozzle.

The invention can be used in industrial burners, gas nozzles, and in the design of compact windshield washer nozzles for example.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
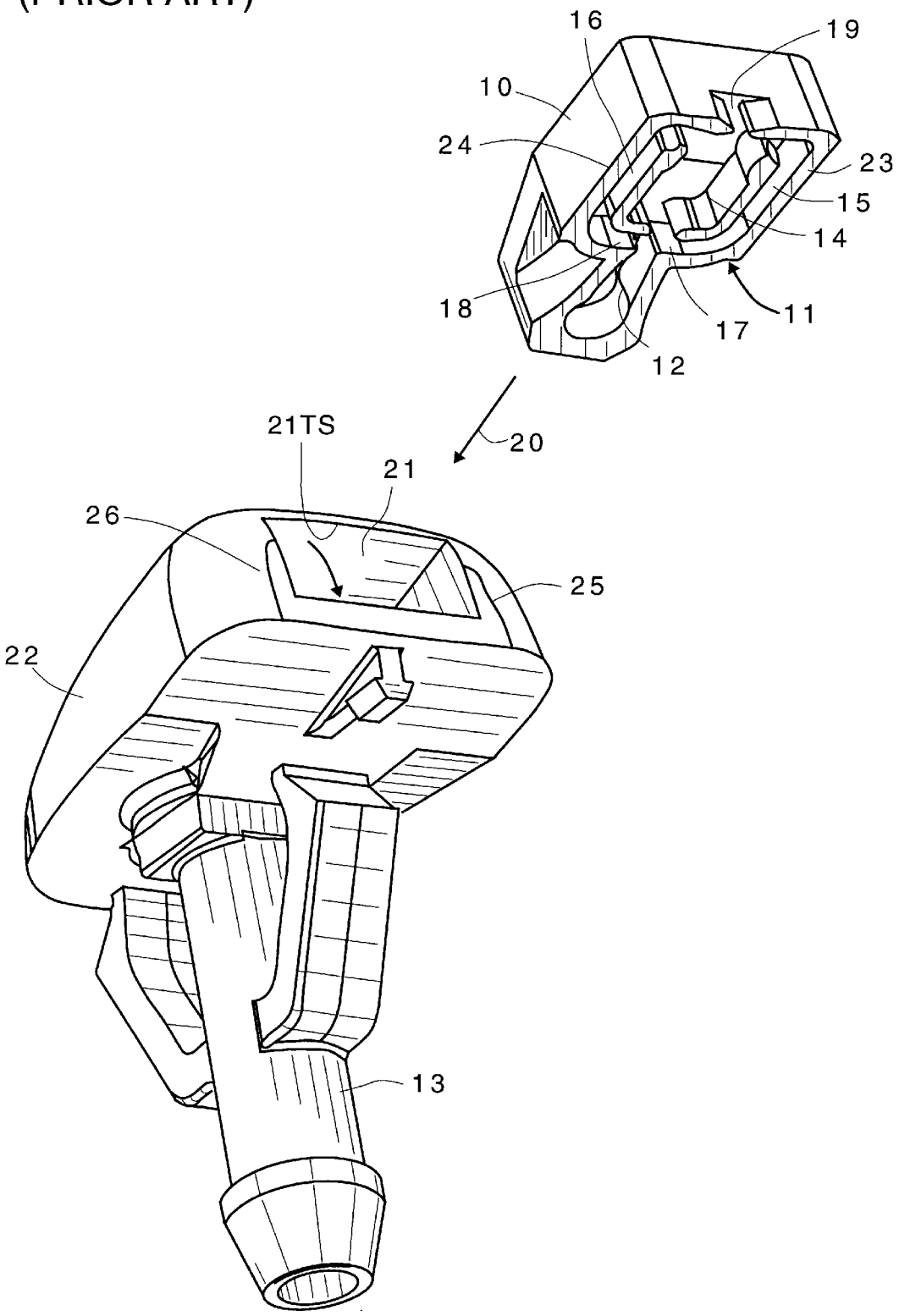
FIG. 1 (PRIOR ART)
FIG. 1 is a simplified isometric view of the technique and process disclosed in the aforementioned U.S. Pat. No. 4,185,777 and is hence prior art, FIGS. 2A and 2B.

Referring now to FIG. 1, a conventional prior art fluidic element is constructed of a molded or machined fluidic element 10 having formed in one surface thereof a fluidic oscillator silhouette 11. Fluidic oscillator silhouette 11 in this embodiment is of the type disclosed in Stouffer U. S. Pat. No. 4,508,267. It will be appreciated that other types of fluidic oscillators may be used such as shown in, for example, Bray U.S. Pat. No. 4,645,126 and Bray U.S. Pat. No. 4,463,904 as well as oscillators of the type disclosed in the aforementioned U.S. Pat. No. 4,185,777. In silhouettes shown in FIG. 1, a power nozzle 12 is adapted to be supplied with a source of fluid under pressure 13 and issues a jet of pressurized fluid into the oscillation chamber 14. A system of vortices is established in the oscillation chamber which controls fluid flowing into control passages 15 and 16 and out of control ports 17 and 18, respectively. This system of vortices and flow in the control passages causes the fluid issuing through the power nozzle 12 to oscillate back and forth and to issue through outlet 19 in an oscillating fashion sweeping back and forth. The oscillator chip 10 is inserted in the direction of the arrow 20 in a recess 21 formed in housing 22 until the power nozzle 12 is in proper alignment with the source of fluid under pressure 13 to form the completed oscillator. The surface 21 TS in recess 21 is designed to form a seal for the fluidic silhouette per se.

Note that the material 23, 24 of the chip 10 forming the outside boundaries of the control or feedback passages 15 and 16, respectively, is bounded by the material forming the outside walls 25, 26 of the housing 22. It is a particular feature of this invention that such material is made redundant according to one main feature of the invention.

THE PRESENT INVENTION

Figure 2B:
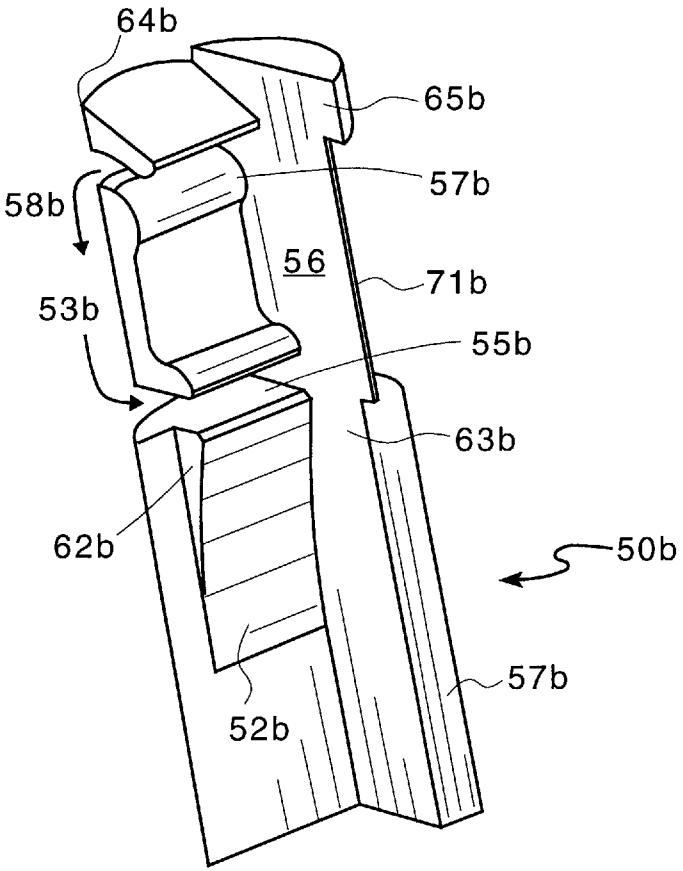
FIG. 2B is an isometric perspective view looking downwardly from the outlet region.
Figure 2A:
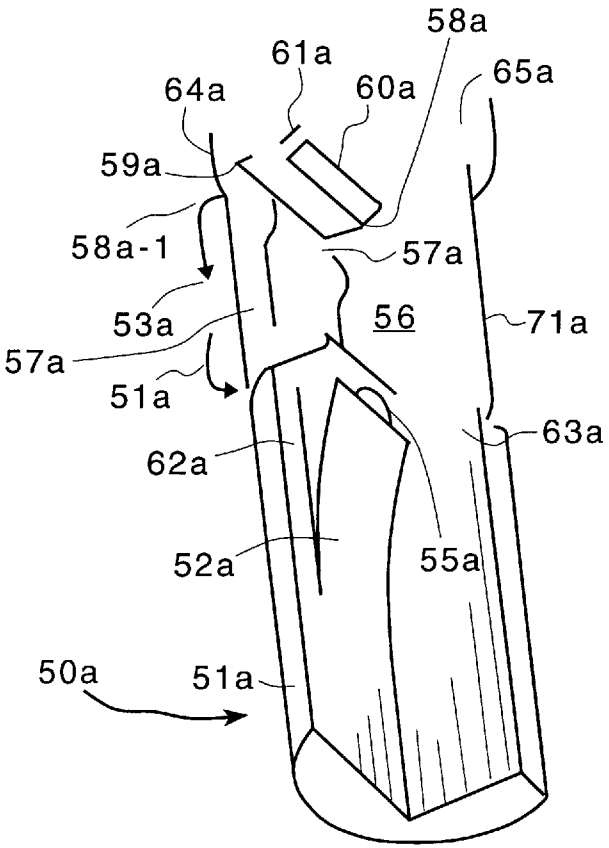
FIG. 2A is an isometric view taken from a view looking from the direction of the power nozzle upwardly.

Referring now to the embodiment shown in FIGS. 2A, 2B, 3 and 4, the internal portions of the cylindrical oscillator are formed in two parts as shown in FIGS. 2A and 2B, respectively. Referring now to FIG. 2A and FIG. 2B, these figures are essentially structures which are mirror images of one another so a description of one suffices to describe the other.

Referring to FIG. 2A, the element 50*a* includes a power nozzle portion 51*a* having a tapering wall portion 52*a* which corresponds to a portion of the power nozzle 12 of FIG. 1.

The power nozzle half portion 52*a* coacts with the corresponding power nozzle half portion 52*b* in the mating portion 50*b* to form a power nozzle for issuing a jet of pressurized fluid into the oscillation chamber portion 56. The oscillation chamber portion 53*a* includes a projection member 54*a* which is offset slightly and spaced downstream of a power nozzle so as to define the boundaries of the control port 55*a*, and a lower portion of the oscillation chamber 56. The oscillation chamber 56 includes walls 57*a* and a protuberance 58*a* which defines the lower boundary of the control passage ingress 58*a*-1 and is also shaped as at 59*a* to define the mouth of the outlet region 60*a* with the upper portion tapered as at 61*a* to define the outlet flare which is the physical boundary for the fluid jet issuing in a sweeping fashion through the outlet.

Figure 4:
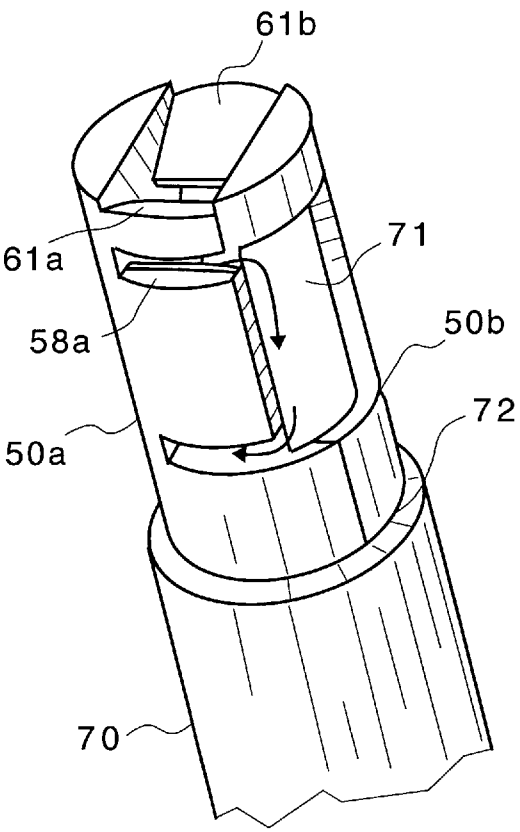
FIG. 4 shows the two identical elements interfitted together and being force-fitted into a cylindrical housing to form the operative fluidic oscillator element with its control or feedback passages.
Figure 3:
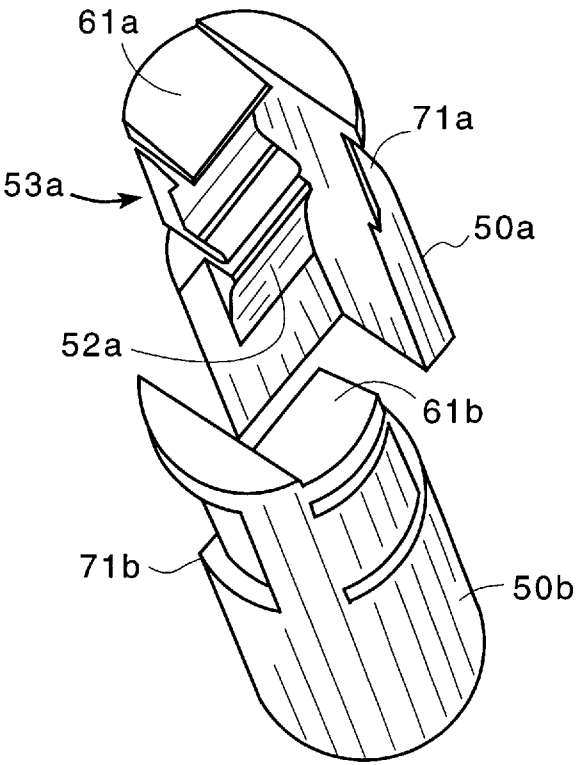
FIG. 3 shows the two identical elements as they are about to be fitted together.

It will be noted that in FIGS. 2A and 2B there are no boundaries or the outside walls of the control or feedback passages. As shown in FIG. 3, the elements 50*a* and 50*b* are juxtaposed and mated for assembly into an operative unit and for insertion into a cylindrical housing 70 as shown in FIG. 4. In FIG. 4, the elements 50*a* and 50*b* are interfitted so that the surface notch 62*a* receives the surface 63*b*. Similarly, the surface 64*a* is butted and sealed against the surface 65*b* and the surface 65*a* butts up against and seals against the surface 64*b*. Surface 63*a* butts up against and fits into surfaces 62*b* and element 50*b*. The mated assembly of elements 50*a* and 50*b* is shown in FIG. 4 being force-fitted into a cylindrical housing 70. Note in particular the feedback egresses and the control passages 71 are formed on the exterior surfaces of elements 50*a* and 50*b*. As these nested and mated components 50*a* and 50*b* are telescoped inside housing 70, interior walls 72 of housing 70 forms the exterior wall surfaces for the feedback or control passages 71 which interconnect control or feedback passage egress 58*a*, 58*b* with control ports 55*a*, 55*b* on opposite sides of the power nozzle formed by mated elements 52*a* and 52*b*. When assembled and telescoped within housing 70, the units have the configuration of the fluidic oscillators shown in FIG. 1 and operates in essentially the same manner. In this case, the inside walls 72 of housing 70 forms the boundary or outside walls of the feedback passages thereby eliminating material used to form this walls and thereby enabling a more compact fluidic oscillator device.

The elements 50*a* and 50*b* can be formed by injection molding processes and hence can be manufactured at low cost.

Figure 5:
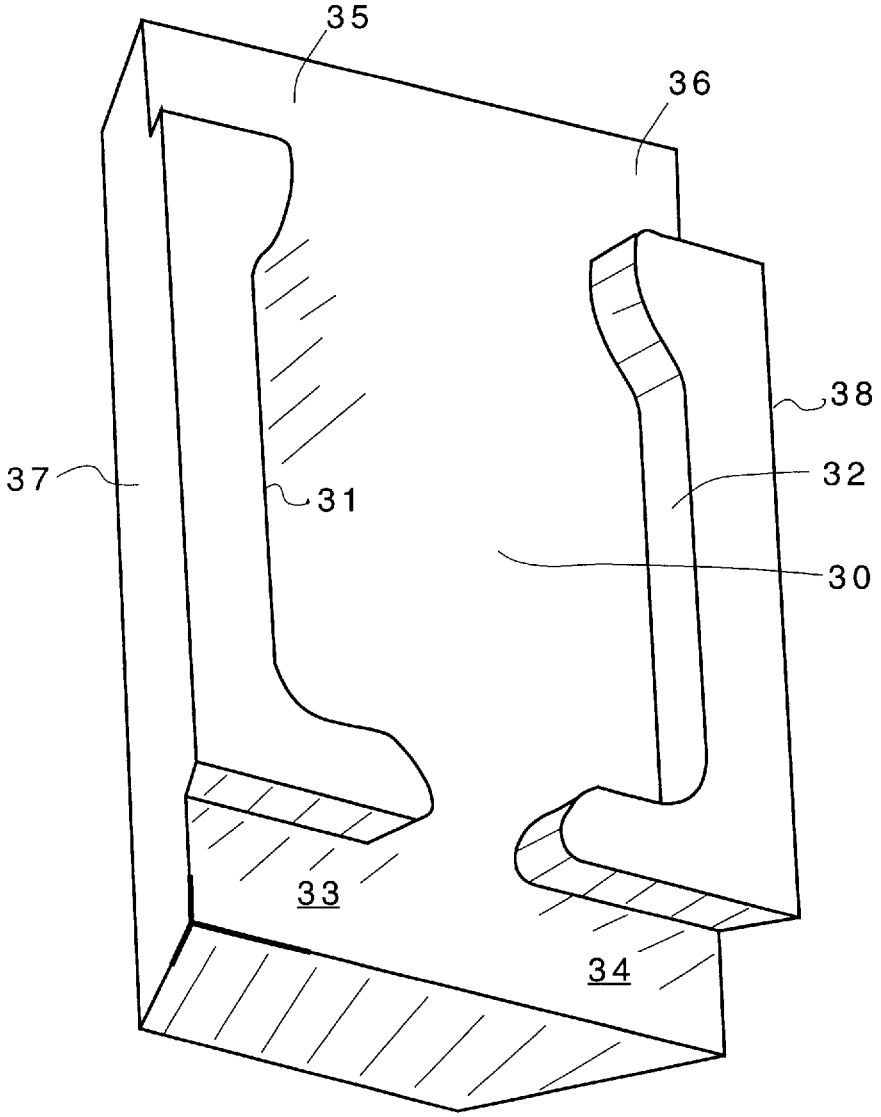
FIG. 5 is an isometric perspective view of the silhouette geometry of one-half of the power nozzle oscillation chamber and portions of the control for insuring oscillation of a fluidic oscillator.

Referring now to FIG. 5, a portion of the fluidic oscillator, which in this embodiment is of the type shown in FIG. 1, comprises an oscillation chamber 30 having a pair of sidewalls 31, 32, a pair of control ports 33, 34 and portions of control passage or feedback passage ingresses 35 and 36 and portions of control or feedback passages 37, 38, respectively.

Figure 6:
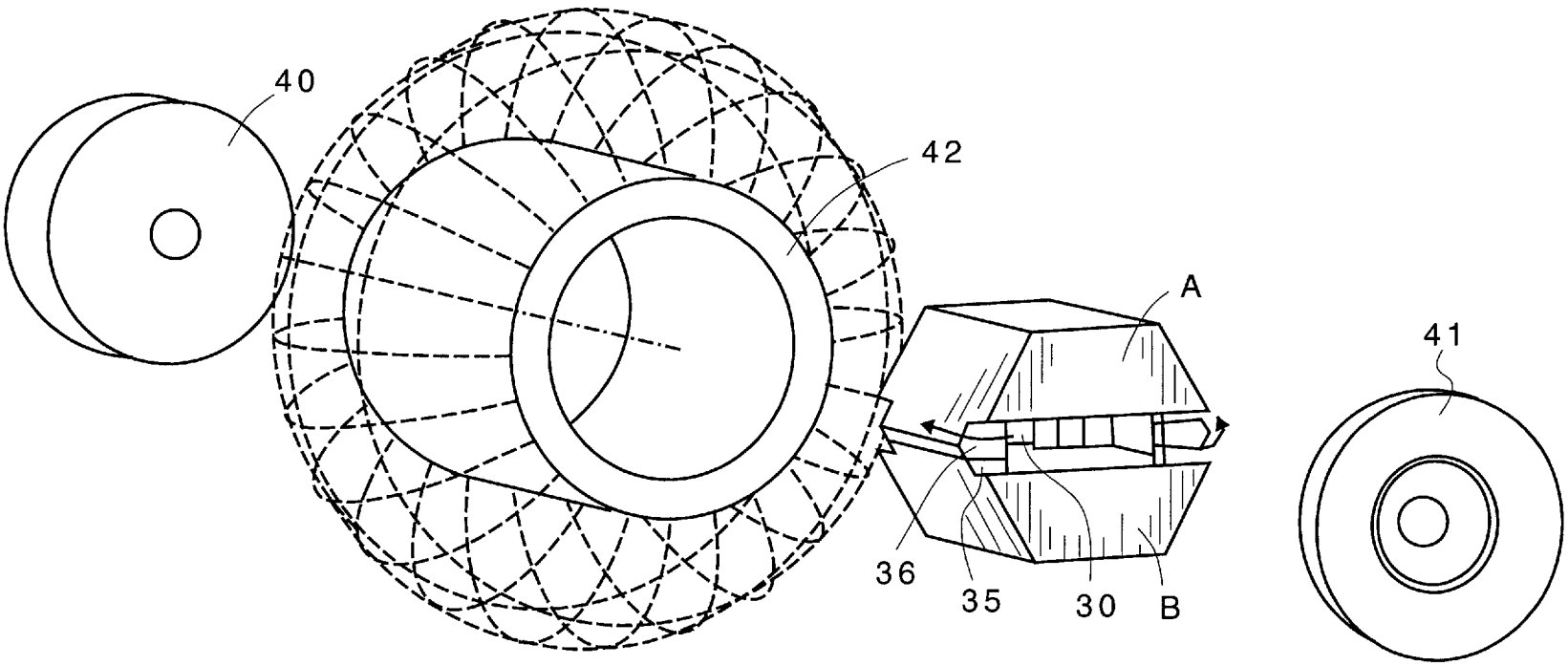
FIG. 6 shows an exploded view of two of the silhouette elements in juxtaposed relation to a power nozzle and outlet element.
Figure 7:
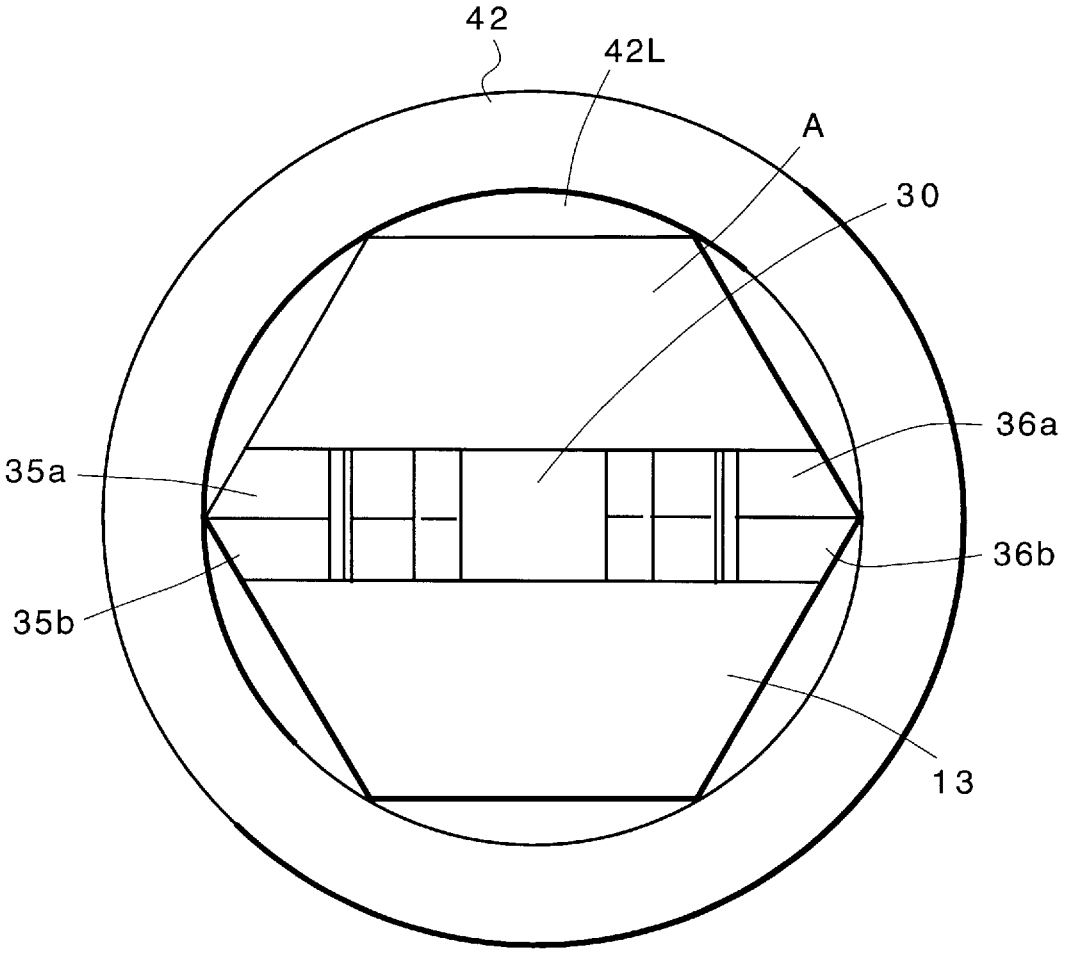
FIG. 7 is an end view showing the outlet end of the fluidic element as assembled without the end ring outlet element.

As shown in FIG. 6A, a pair of the modules shown in FIG. 5 are sandwiched in abutting relation as shown in FIG. 7 with half of the fluidic element oscillating chamber 30 in the upper half and the lower half containing the lower half of the oscillation chamber. It will be appreciated that all of the oscillation chamber silhouette can be formed in one member as shown in FIG. 2 and a flat seal surface constituting the lower half of the oscillation chamber.

The two members are then sandwiched between a power nozzle member 40 and an outlet seal member 41 and these units then fitted inside a cylindrical housing 42 (FIG. 6B). In FIG. 6A, the arrows indicate the direction of fluidic flow in the control or feedback passages and, the same arrows are shown in FIG. 7. Note that the spaces between the inner walls 42*i* of cylindrical member 42 form the outside boundaries of the control or feedback passageways which interconnect the control passage or feedback ingresses 35 and 36 with the control ports 33, 34, respectively. Thus, the external housing 42 has an internal wall which serves as the outside wall for the feedback or control passages with the inner walls being served thereby by the wall surfaces 37, 38 as shown in FIGS. 5, 6A and 7. In connection with the power nozzle member 40, the power nozzle has the same internal configuration as the power nozzle 18 shown in FIG. 1. The outlet shown in the outlet member 41 has the same general configuration as the outlet 19 shown in FIG. 1. The outlet/seal member 41 forms the upper boundary for the control passage ingress and egress elements 35, 36, respectively. Oscillations in the assembled oscillator components takes place essentially in the manner described earlier in connection with said prior art in oscillators shown in FIG. 1.

In either embodiment, the cylindrical housing can have a spherical outer shape indicated by doted lines in FIG. 6B so that the device can be mounted in a spherical socket and be easily mechanically adjustable to change the aiming angle.

While various embodiments and adaptations of the invention have been illustrated and described, it will be appreciated that other adaptations, modifications and changes to the invention will be readily apparent to those skilled in the art.

What is claimed is:

1. A fluidic oscillator comprising:

a housing having interior walls defining a cylindrical space therein, a fluidic oscillator element mounted in said cylindrical space and having an oscillating chamber, said oscillating chamber having an upstream end and a downstream end, a power nozzle for issuing a jet of fluid into said oscillation chamber from said upstream end thereof, an outlet formed in said downstream end, a pair of control ports at opposing sides of said power nozzle, a pair of feedback entranceways in the downstream end of said chamber and at corresponding opposing sides of said outlet, and a pair of control passageways for connecting each said feedback entranceway with said control ports on said opposing sides, respectively, each said control passageway being formed in part by said interior wall and said fluidic oscillator element.

2. The fluidic oscillator defined in claim 1 wherein said element is formed in two parts having complementary mating surfaces.

3. The fluidic oscillator defined in claim 1 wherein said power nozzle is formed as a separate cylindrical element.

4. The fluidic oscillator defined in claim 1 wherein said outlet is formed as a separate cylindrical element.

5. A fluidic oscillator comprising:

a housing having interior walls defining a cylindrical space therein, a pair of mated elements forming a fluidic oscillator mounted in said cylindrical space, said mated elements having an oscillating chamber, said oscillating chamber having an upstream end and a downstream end, a power nozzle for issuing a jet of fluid into said oscillation chamber from said upstream end thereof, an outlet formed in said downstream end, a pair of control ports at opposing sides of said power nozzle, a pair of feedback entranceways in the downstream end of said chamber and at corresponding opposing sides of said outlet, and control passageway connecting each said feedback entranceway with said control ports on said opposing sides, respectively, each said control passageway being formed in part by said interior wall and said element.

* * * * *